United States Patent [19]

Hora et al.

[11] 3,985,631

[45] Oct. 12, 1976

[54] PRETREATMENT AND START-UP OF ELECTROLYTIC CELL MEMBRANES

[75] Inventors: Charles J. Hora, Willoughby Hills; Andrew D. Babinsky, Chagrin Falls, both of Ohio

[73] Assignee: Diamond Shamrock Corporation, Cleveland, Ohio

[22] Filed: Aug. 13, 1975

[21] Appl. No.: 604,429

[52] U.S. Cl. ..... 204/98; 204/128; 204/296

[51] Int. Cl.[2] ..... C25B 1/16; C25B 1/26; C25B 13/00; C25B 15/00

[58] Field of Search ..... 204/98, 128, 296

[56] References Cited

UNITED STATES PATENTS

| | | | |
|---|---|---|---|
| 2,967,807 | 1/1961 | Osborne et al. | 204/128 |
| 3,689,438 | 9/1972 | Bourat et al. | 204/296 |
| 3,773,634 | 11/1973 | Stacey et al. | 204/98 |

*Primary Examiner*—R. L. Andrews
*Attorney, Agent, or Firm*—Timothy E. Tinkler

[57] ABSTRACT

Cation-exchange membranes for use in the electrolysis of alkali metal chloride solutions are treated in order to introduce hydrated alkali metal ions throughout the membrane and are subsequently installed in a cell and subjected to an applied voltage not in excess of about 6.5 to 8.5, passage of current and electrolysis occurring immediately.

7 Claims, No Drawings

PRETREATMENT AND START-UP OF ELECTROLYTIC CELL MEMBRANES

BACKGROUND OF THE INVENTION

Recently, emphasis has been placed on the development of membrane-type electrolytic cells for the production of alkalis and halogens, especially caustic and chlorine. This has come about primarily owing to the objections to the introduction of mercury and asbestos into the environment from the conventional chloralkali processes and is made possible because truly satisfactory membranes for such processes have only recently become available. However, due to previous inexperience with membrane cells for the electrolysis of alkali metal chloride except on a laboratory scale, unexpected problems have arisen in attempting to scale up prior technology to a commercial level.

For example, because these membranes swell considerably upon conversion from a dry to a wet state, it is desirable to install said membranes in a wet condition to avoid subsequent alterations in dimension. However, while maintaining small membranes in a wet condition presents no problems, handling of large, wet membranes is difficult and assembly is not always rapid enough to preclude drying of the membrane.

After installation of the membrane and assembly of the cell, it is essential that electrolysis be commenced rapidly to prevent the necessity for keeping an entire cell circuit closed down while waiting for one cell to come on line. However, even at high applied voltages, e.g., 10 volts or more, most cation-exchange membranes fail to pass significant amounts of current until they have become equilibrated, i.e., thoroughly conditioned with current-transporting ionic species.

Attempts to reduce the conditioning time in situ meet with problems. The application of high voltages in order to force the conditioning process often results in damage to the membrane, especially those membranes the surfaces of which are tightly cross-linked. While heat speeds the conditioning process, the application of heat within a commercial cell requires additional equipment. High strength alkali metal hydroxide solutions work to advantage but are detrimental to the dimensionally stable anodes routinely employed. Such solutions also initially cause dehydration of the membrane to occur, again resulting in a change in dimension.

STATEMENT OF THE INVENTION

Therefore, it is an object of the present invention to provide a method for the pretreatment of and commencement of operation with a cation-exchange membrane in a cell for the electrolysis of alkali metal chloride solutions.

This and further objects of the present invention will become apparent to those skilled in the art from the specification and claims which follow.

There has now been found a method of pretreating a cation-exchange membrane and commencing the electrolysis of alkali metal chloride solutions with same, which method comprises the following sequence of steps:

a. immersing said membrane in an aqueous alkali metal hydroxide solution for a period of time sufficient to introduce hydrated alkali metal ions substantially throughout said membrane, b. withdrawing the thus-treated membrane from said solution, c. mounting the treated membrane between the anode and cathode compartments of an electrolytic cell, thereby separating said compartments, d. introducing aqueous alkali metal hydroxide to the cathode compartment and aqueous alkali metal chloride to the anode compartment, e. imposing a potential not in excess of about 6.5 to 8.5 volts across said cell, f. immediately passing a direct current through said membrane between the anode and cathode of said cell, and g. when said direct current reaches the desired operating level, regulating the voltage to maintain said current density.

Preferably, subsequent to pretreatment but prior to installation in the cell, the membrane will have its surface substantially dried.

A number of advantages follow the aforesaid method. It is now possible to pretreat the membrane in order to render it effective for electrolysis outside of the cell, without concern for the length of time that will subsequently transpire prior to installation and operation. Thus, assembly of a cell can proceed at a convenient pace, spare cells can be assembled and stored dry, and/or the membrane itself may be stored for future use. Since the treated membranes pass current immediately, it is possible to rapidly achieve an operating current density without damage to the membrane and without taking a cell or cell circuit out of service for any significant period of time. Further, since pretreatment occurs exterior the cell, there is no detrimental effect upon other cell components, such as the anodes.

DESCRIPTION OF THE PREFERRED EMBODIMENTS

The techniques of the present invention apply to electrolytic processes employing cation-exchange membranes in the electrolysis of aqueous alkali metal chloride solutions, generally to produce chlorine and alkali metal hydroxides but also in the production of alkali metal carbonates by the introduction of carbon dioxide into the cathode compartment. The term "alkali metal" as used herein refers to potassium and sodium. Particular reference will be made hereinafter to the electrolysis of sodium chloride to produce chlorine and sodium hydroxide.

Cells for such processes generally comprise vertically disposed anodes and cathodes in appropriate compartments and physically separated by the cation-exchange membranes. Such cells may be either monopolar or bipolar in design.

In the operation of such cells, alkali metal chloride solution is introduced into the anode compartment and water or alkali metal hydroxide solution to the cathode compartment, at least initially. Application of a potential across the cell causes the transport of hydrated sodium ions through the membrane from the anode to the cathode compartments.

The invention applies generally to any cation-exchange membrane useful in alkali metal chloride electrolysis wherein operation is dependent upon hydrated alkali metal ion migration through the hydraulically impermeable membrane from the anode to the cathode compartments. Typically and preferably, because of their resistance to the cell environment and suitability for the high current efficiency production of relatively concentrated caustic solutions, the membranes are derived from (i.e., result from the amination and saponification of) any fluorinated polymer having pendant side chains bearing sulfonyl groups attached to carbons, on each of which carbons there is at least one fluorine atom. The fluorinated polymers are prepared from monomers that are fluorinated or fluorine-substituted vinyl compounds. They are made from at least two monomers with at least one of the monomers coming from each of the groups (1) fluorinated vinyl compounds, such as vinyl fluoride, hexafluoropropylene, vinylidene fluoride, trifluoroethylene, chlorotrifluoroethylene, perfluoro (alkyl vinyl ether), tetrafluoroethylene, and mixtures thereof, and (2) a sulfonyl-containing monomer containing the precursor $-SO_2F$. Exemplary of the latter are $CF_2{=}CFSO_2F$ and, generically, $CF_2{=}CFY_fSO_2F$, wherein $Y_f$ is a bifunctional perfluorinated radical containing from 2–8 carbon atoms. Particularly preferred at this time are copolymers of tetrafluoroethylene with perfluoro(3,6-dioxa-4-methyl-7-octenesulfonyl fluoride) having equivalent weights within the range of 1000 to 1300, especially 1100–1200 (grams of polymer per equivalent of proton). The preferred cation-exchange membranes of the type in question are further and more fully described in the following references, the teachings of which as to resin structure and preparation are hereby incorporated by reference: U.S. Pat. Nos. 3,041,317; 3,282,875; 3,624,053; Dutch Published Application 72/12249; and British Patent 1,184,321.

The foregoing preferred membranes, generally having a thickness of from 75 to 250 microns, are then converted from the sulfonyl form into the active alkali metal or acid form, generally by saponification with potassium hydroxide and dimethylsulfoxide (as an accelerant). More useful, however, are the newer membranes of the same chemical and physical nature but having at least the cathode-facing surface thereof, and optionally, the entire thickness, treated with monoamines, such as methylamine or n-butylamine, or with a compound capable of forming cross-links between the reactive sites, e.g., polyamines such as ethylene diamine, diethylene triamine, dipropylene triamine, triethylene tetraamine, and the isomers thereof.

Conveniently, the cross-linking treatment may proceed simply by placing the unhydrolyzed sulfonyl form membrane in a suitable asymmetric treating vessel and adding an amine/water solution (typically having a 15–20:1 volume ratio) while maintaining the temperature between 20° and 120° C. Time of treatment will determine the depth of cross-linking. Following washing, conversion to the alkali metal form takes place conventionally, e.g., employing an aqueous DMSO-KOH solution.

Such a cross-linked membrane acts to prevent back-migration of hydroxide ion from the cathode to anode compartments therefore achieving a greater caustic-based current efficiency. Thus, it is important to preserve the cross-links, which can be disrupted both in handling, owing to the brittleness imparted by the additional cross-linking, and especially by the imposition of a voltage in excess of about 6.5 to 8.5.

The first step in the instant method is the pretreatment or conditioning of the cation-exchange membrane to introduce hydrated cationic species, generally of the same nature as the predominant cation in the alkali metal chloride solution to be electrolyzed, i.e., hydrated sodium ions in the case of sodium chloride.

As received, particularly with the preferred polyfluorocarbon resins bearing pendant sulfonic acid groups, whether amine treated or not, the membrane is either in the potassium or acid form, this for the reason that potassium chemically converts the sulfonyl precursor to the active ($-SO_3K$) form more quickly than does sodium. In any event, even if the exchange sites are in the sodium form, this is not equivalent to the objective of the pretreatment step, i.e., the physical introduction of hydrated sodium ions throughout the membrane. The pretreatment step is effected by immersing the membrane in aqueous sodium hydroxide solution at concentrations approaching those to be found in the cell during operation, for a period of time sufficient to introduce hydrated sodium ions substantially throughout the cross-section of the membrane. Typical is the use of 100 to 450 g/l, especially 150 to 350, solutions for from 4 to 15 hours, although the conditioning treatment may be accelerated by the application of heat.

Following the conditioning treatment, the membrane may be withdrawn and directly installed in the cell. However, in the preferred embodiment, it has been found that if the treated membrane is removed and substantially dried, for example by blotting excess solution from the surface and allowing to stand at room temperature for 4 or more hours, the membrane may then be handled, stored, etc. for extended periods of time while still realizing the advantages previously described. Thus, maintenance, replacement, and even initial installation of the membranes within the cells are facilitated, since concern with drying of the membrane and loss of conductivity is removed.

In any event, whether the conditioned membrane has been dried or directly taken from the pretreating bath to the cell room the next step is the installation of said membrane in the cell between the anode and cathode compartments. This is accomplished in conventional fashion depending upon cell design, which is not a concern of the present invention.

When so installed and sealed, the cathode compartment is flooded with sodium hydroxide solution while the anode compartment receives sodium chloride solution, both at concentrations approaching those obtained during operation, e.g., 300 – 500 g/l of NaOH and 200 – 310 g/l NaCl.

While maintaining the brine flow, a potential not substantially in excess of 6.5 to 8.5 volts is applied across the cell. It will be understood that the value 6.5 – 8.5 volts may vary somewhat depending upon a variety of conditions. Lower voltages may be employed but will require a longer period of time before the desired current density is achieved. As mentioned previously, an upper limit of about 6.5 to 8.5 volts cannot be exceeded for significant periods of time in most instances without realizing deterioration of the membrane and a disadvantage with respect to current efficiency. Maintenance of a potential of from 4.0 to 6.5 volts during start-up is optimum.

On applying said potential, an immediate flow of current, often as high as 8 amperes per square decimeter of membrane surface, is observed and electrolysis begins. The current density rises as the applied voltage is maintained until the desired value is reached, a current density of 15 asd often being obtained within 1 to 10 minutes. When the desired value, e.g., 30 asd, is attained, the voltage is then controlled, generally at some lower potential, to maintain said desired current density.

In order that those skilled in the art may more readily understand the present invention and certain preferred embodiments by which it may be carried into effect, the following specific example is afforded.

EXAMPLE

The membrane employed is a copolymer formed from seven parts of tetrafluoroethylene and one part of $CF_2{=}CFOCF_2CF\text{-}(CF_3)OCF_2CH_2SO_2F$, having a thickness of 178 microns and an equivalent weight of 1200 (grams of polymer per equivalent of proton). One surface of the membrane has been cross-linked to a depth of 51 microns by treatment in an asymmetric vessel at a temperature of 25° C with an ethylene diamine/water solution (18:1 volume ratio) for 152 minutes. Following water washing, the membrane has been saponified at 90° C for 70 minutes in a solution of 600 ml $H_2O$, 400 ml dimethylsulfoxide and 13 weight percent KOH.

Said membrane, after water rinsing, is immersed in an aqueous 150 g/l NaOH solution for 4 hours at room temperature, following which it is removed, blotted dry with absorbent toweling, and allowed to air dry for 24 hours, again at room temperature.

Without further treatment, the membrane is then installed in a two-compartment cell, spaced 1.6 mm from a nickel cathode and 3.2 mm from an opposed, expanded, titanium metal anode bearing a $2TiO_2{:}RuO_2$ mole ratio coating on its surface. Saturated brine (310 g/l) at a temperature of 30° C and a pH of 2.0 is then passed through the anode compartment while a NaOH solution at a concentration of 400 g/l is used to flood the cathode compartment. A potential of 4.5 volts is applied across the cell and a current density between the electrodes is immediately measured at a value of 8 asd. Maintaining the stated voltage, the current density climbs in 10 minutes to 15 asd and, 15 minutes later, to the desired current density of 30 asd. Thereafter, operation continues at 30 asd and a voltage of 4.1–4.5 to produce 450 g/l NaOH at a current efficiency of 95%.

By comparison, an identical aminated membrane is installed without caustic pretreatment, water is introduced to the anode compartment, and a 370 g/l NaOH solution to the cathode compartment. At an applied voltage of 10, substantially no current (i.e., less than 0.1 amp) flows for 90 minutes. When the desired current density of 30 asd is finally reached after 4 hours, saturated brine is introduced to the anode compartment and operation is commenced. However, a caustic-based current efficiency of only 80–85% is realized.

We claim:

1. A method of pretreating a cation-exchange membrane and commencing electrolysis of an alkali metal chloride solution with said membrane, which method comprises the following sequence of steps:

a. immersing said membrane in an aqueous alkali metal hydroxide solution for a period of time sufficient to introduce hydrated alkali metal ions substantially throughout said membrane,
b. withdrawing the thus-treated membrane from said solution,
c. substantially drying the surfaces of the membrane,
d. subsequently mounting the treated, dried membrane between the anode and cathode compartments of an electrolytic cell, thereby separating said compartments,
e. introducing aqueous alkali metal hydroxide to the cathode compartment and aqueous alkali metal chloride to the anode compartment,
f. imposing a potential not in excess of 8.5 volts across said cell,
g. immediately passing a direct current through said membrane between the anode and cathode of said cell, and
h. regulating the voltage to maintain the desired current density.

2. A method as in claim 1 wherein the cation-exchange membrane is derived from a fluorinated polymer having pendant side chains bearing sulfonyl groups attached to carbons, on each of which carbons there is at least one fluorine atom.

3. A method as in claim 2 wherein said membrane has been cross-linked with a polyamine.

4. A method as in claim 2 wherein said membrane has been surface treated with a monoamine.

5. A method as in claim 1 wherein said alkali metal is sodium.

6. A method as in claim 1 wherein said alkali metal hydroxide is NaOH and its concentration in step (a) is from 100 to 450 g/l.

7. A method as in claim 1 wherein the potential in step (f) is within a range of 4.0 – 6.5 volts.

* * * * *